US011067372B2

(12) United States Patent
Schorr et al.

(10) Patent No.: US 11,067,372 B2
(45) Date of Patent: Jul. 20, 2021

(54) ORDNANCE NOSE CONE

(71) Applicant: BAE Systems Information and Electronic Systems, Nashua, NH (US)

(72) Inventors: David J. Schorr, Austin, TX (US); Jason Batchelder, Lyndeborough, NH (US); Richie Spitsberg, Manchester, NH (US); Kenneth Cleveland, Hollis, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 16/703,023

(22) Filed: Dec. 4, 2019

(65) Prior Publication Data

US 2021/0172717 A1 Jun. 10, 2021

(51) Int. Cl.
*F42B 10/46* (2006.01)
*F42B 10/34* (2006.01)

(52) U.S. Cl.
CPC ..... *F42B 10/46* (2013.01); *F42B 10/34* (2013.01)

(58) Field of Classification Search
CPC ..... F42B 10/34; F42B 10/36; F42B 10/52; F42B 15/36
USPC ..... 102/202.14, 275.9, 275.11, 275.12
See application file for complete search history.

(56) References Cited

U.S. PATENT DOCUMENTS 3,135,204 A * 6/1964 Menichelli ..... F42B 15/36 102/399
3,699,892 A * 10/1972 Kopec ..... F42C 13/04 102/214
3,706,281 A * 12/1972 Hatakeyama ..... F42B 15/36 102/378
3,757,698 A * 9/1973 Jacobson ..... F42B 10/46 244/131
4,788,914 A * 12/1988 Frater ..... F42B 10/46 102/293
5,743,492 A * 4/1998 Chan ..... B64F 1/04 102/274
2009/0314890 A1* 12/2009 Koehler ..... F42B 12/76 244/119
2010/0058946 A1* 3/2010 Geswender ..... F42C 19/02 102/206
2015/0247714 A1* 9/2015 Teetzel ..... G05D 1/107 244/3.11
2015/0291271 A1* 10/2015 Benner ..... B64C 1/12 403/376
2017/0045344 A1* 2/2017 Rodriguez ..... B64C 1/0009

* cited by examiner

*Primary Examiner* — Bret Hayes
(74) *Attorney, Agent, or Firm* — Finch & Maloney, PLLC; Scott J. Asmus

(57) ABSTRACT

An ordnance includes a nose cone configured to be attached to a fuze or a warhead. The nose cone, when attached or coupled to the fuze or warhead, covers the fuze and at least a portion of the warhead to provide the ordnance with an aerodynamic profile. The nose cone has a shape that improves the aerodynamic profile of the ordnance as compared to ordnance that does not include a cover over the fuze. The improved aerodynamic profile enables the ordnance to achieve a greater range (approximately 20% or more) than ordnance that does not have a separate nose cone covering the fuze.

20 Claims, 8 Drawing Sheets

ORDNANCE NOSE CONE

FIELD OF THE DISCLOSURE

This disclosure relates generally to the field of ordnance, and more particularly, to techniques for extending the range of ordnance.

BACKGROUND

A warhead is an explosive material that is delivered by a missile or other vehicle. In some cases, the warhead is mounted to the nose of the missile or rocket, also referred to as ordnance in the context of a launched weapon whether by air, ground or sea. Conventional warhead designs, such as the M151 High Explosive Dual Purpose (HEDP) warhead with an M423 fuze, have poor drag characteristics, which hinders the maximum effective range of the missile. For certain projectiles that are launched and have limited or no propulsion capabilities, the effects of poor drag can limit the range of the projectile. Non-trivial issues associated with extending the range of a rocket remain due to the limitations of existing designs, including the shapes of the fuze and the warhead as well as limitations on any propellants.

DETAILED DESCRIPTION

Techniques are disclosed for extending the range of ordnance, including, for example, a 2.75-inch diameter fin-stabilized rocket with a warhead such as used in air-to-ground roles. Such rockets can, for example, be launched from aircraft platforms, although it will be understood that the disclosed embodiments can be implemented in weapons designed to be launched from several types of platforms, including air-, ground-, or ship-based platforms. One example is the Hydra 70 unguided rocket which can be converted to a precision guided munition in certain cases. In accordance with certain embodiments of the present disclosure, a nose cone is configured to be attached to a fuze, which is attached or coupled to the forward portion of a warhead, or to the warhead. In some embodiments, the fuze is the part of the device that initiates a function, such as an exploder or detonator, and is generally located on the forwardmost part of the ordnance. An example of a fuze can include an impact fuze that detonates when it's forward motion rapidly decreases, such as upon physically striking an object or impacting water, although it will be understood that any type of fuze can be used in conjunction with the disclosed embodiments. The fuze can be separate from the warhead (attachable) or integrated into the warhead (fixed). The nose cone, when attached or coupled to the fuze or warhead, covers the fuze and at least a portion of the warhead to provide the ordnance with an aerodynamic profile. For inert practice ordnance having no fuze—commonly referred to as a slug—the nose cone is configured to be attached to the nose or forwardmost portion of the slug at the same location where a fuze would reside on a live ordnance. The nose cone has a shape that improves the aerodynamic profile of the ordnance as compared to ordnance that does not include a cover over the fuze. The improved aerodynamic profile enables the ordnance to achieve a greater range (approximately 20% or more) than ordnance that does not have a separate nose cone covering the fuze or slug.

Figure 1A:
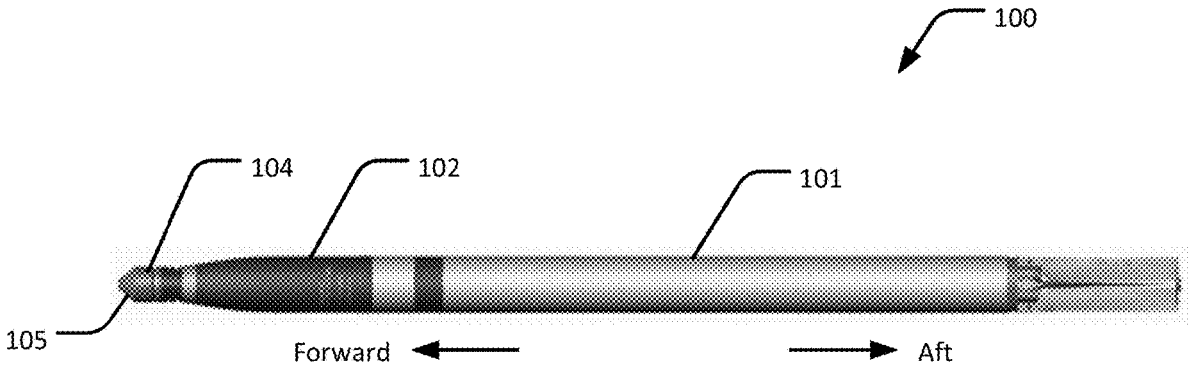
FIGS. 1A and 1B are side views of an example aircraft ordnance, in accordance with an embodiment of the present disclosure.
Figure 1B:
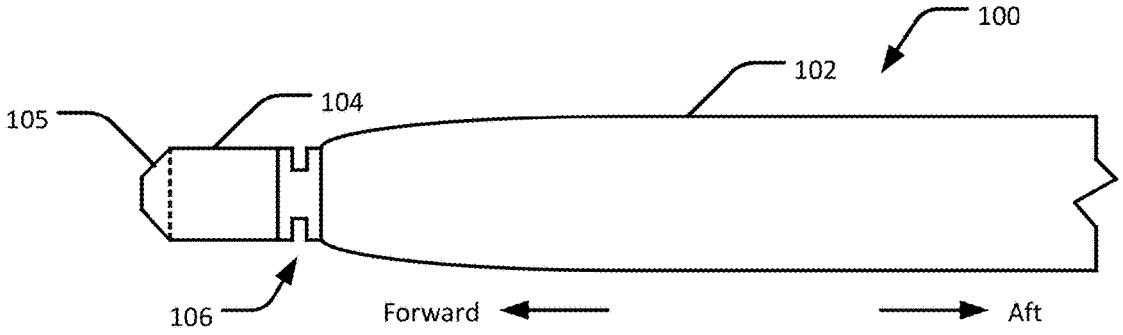

FIGS. 1A and 1B are partial side views of an example ordnance 100, in accordance with an embodiment of the present disclosure. Ordnance 100 includes a rocket motor 101, a warhead 102 attached or coupled to a forward portion of rocket motor 101, and a fuze 104 attached or coupled to a forward portion of warhead 102. The forwardmost portion of fuze 104 includes a nose cap 105, which can be integral to or separate from fuze 104. The combination of warhead 102 and fuze 104 can be mounted, for example, to an air-launched rocket having a 2.75-inch form factor, such as rocket motor 101. In a further embodiment, the unguided rocket can include a guidance and navigation section such as the APKWS® guidance kit that converts an unguided rocket to a guided rocket. The nose cone in one example not only extends the range due to the drag characteristics but enable improved steering using the deployed wings.

It will be understood that warhead 102 and fuze 104 can, in some cases, be inert components, such as found in a slug or practice ordnance. A slug can have a similar surface profile and surface features as the fuze and warhead assembly. The fuze 104/warhead 102 and slug can be used interchangeably with embodiments of this disclosure. A portion of ordnance 100 on or between warhead 102 and fuze 104 includes one or more slots, rings, wrench flats, annular grooves, or other features 106 for mechanically attaching or coupling fuze 104 to ordnance 100, such as by using a wrench or other tool to rotate fuze 104 onto warhead 102, as will be appreciated by one of skill in the art. In some embodiments, features 106 are disposed on or integrated into fuze 104, although they can be part of another component, such as a collar or spacer between fuze 104 and warhead 102 that includes one or more features 106. The example ordnance 100 does not include a nose cone and at least partially incorporates existing designs, including, for example, the M151 warhead and M423 fuze. FIG. 1B depicts that fuze 104 and nose cap 105 have a different aerodynamic profile from warhead 102. Such a profile can have poor drag characteristics, which when exposed during flight hinders the maximum effective range of ordnance 100.

Figure 2A:
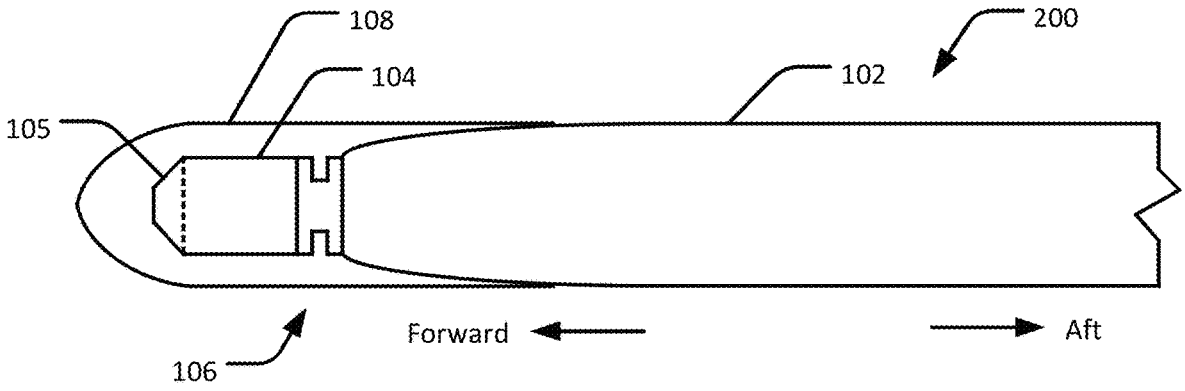
FIGS. 2A and 2B are side and perspective views of an example ordnance with a nose cone, in accordance with an embodiment of the present disclosure.
Figure 2B:
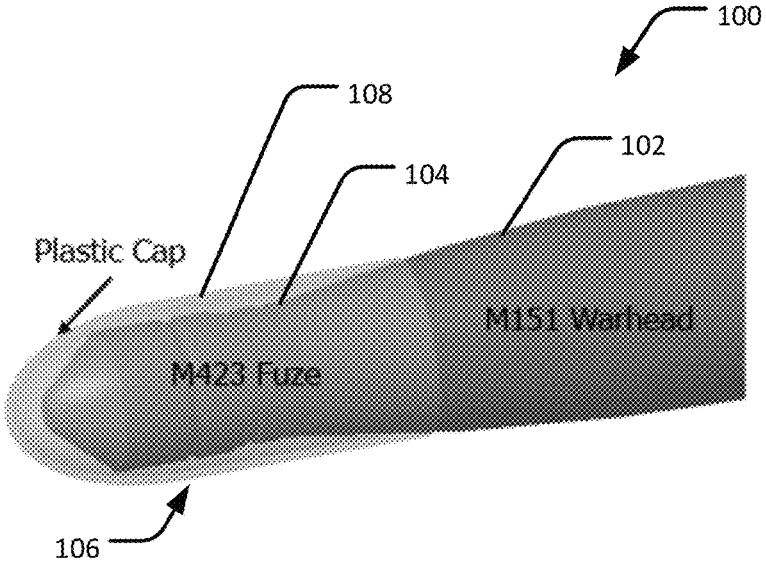

FIGS. 2A and 2B show an example ordnance 200 with a nose cone 108, in accordance with an embodiment of the present disclosure. Ordnance 200 is similar to ordnance 100 of FIG. 1 and further includes nose cone 108 coupled to and covering fuze 104, nose cap 105, and at least a portion of warhead 102 to smooth air flow over fuze 104, nose cap 105, and the body of warhead 102. In some embodiments, nose cone 108 is a lightweight plastic, aluminum, or other suitable material that can be attached to ordnance 200 without adversely affecting the function of fuze 104 upon impact. For example, nose cone 108 can be manufactured using Acrylonitrile Butadiene Styrene (ABS), polyetheretherketone (PEEK), aluminum, or another material with similar properties. For instance, the acrylonitrile in ABS provides chemical and thermal stability, while the butadiene adds durability and strength and the styrene provides a smooth finish. ABS has a low melting point, which is useful for injection molding and 3D printing. ABS, even in thin and lightweight sheets, also has high tensile strength and is resistant to physical impacts and corrosion. Furthermore, ABS can be easily molded, sanded, and shaped to precise specifications. Other materials with properties similar to ABS can be used. In a further embodiment, the unguided rocket can include a guidance and navigation section such as the APKWS® guidance kit that converts an unguided rocket to a guided rocket.

Figure 4:
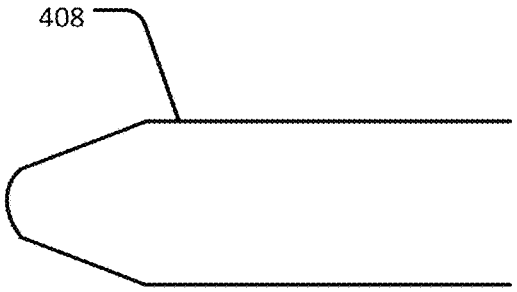
FIG. 4 is a side view of an alternate shape of an ordnance nose cone, in accordance with an embodiment of the present disclosure.

Nose cone 108 has a shape that improves the aerodynamic profile of ordnance 200 in comparison to ordnance 100 of FIG. 1, in which fuze 104 is exposed. For instance, when ordnance 200 includes a Hydra 70 2.75-inch fin stabilized unguided rocket, nose cone 108 can have an ogive shape (such as shown in FIG. 2) that smooths air flow over the fuze, the body of the warhead, and the fins of the rocket, which improves the range and the maneuverability of the rocket. FIG. 4 shows an alternate shape of a nose cone 408 that improves the aerodynamic profile of ordnance 200 in comparison to ordnance 100 of FIG. 1, in which fuze 104 is exposed, in accordance with an embodiment of the present disclosure.

Nose cone 108 can have any number of different shapes that affect the aerodynamic characteristics of ordnance 200, such as shapes having a smooth external surface or an external surface that includes annular or longitudinal ridges, grooves, fins, or other surface features that reduce drag-inducing turbulence over and around ordnance 200 or aid in controlling the trajectory or other flight characteristics of ordnance 200.

In some embodiments, some or all of the external surface of nose cone 108 is coated or embedded with a paint or another material that improves airflow dynamics over nose cone 108 and reduces ice and water accumulation. In some embodiments, some or all of the external surface of nose cone 108 can be coated or embedded with a paint or other material that provides camouflage or counter-illumination. In some embodiments, some or all of the external surface of nose cone 108 can be coated or manufactured with a radiation-absorbent material or non-reflecting material designed to absorb or scatter electromagnetic radiation, light, or sound to provide, for example, radar or sonar counter-measures or to reduce the detectability of ordnance 200.

In some embodiments, nose cone 108 can include structural features designed to control deformation of nose cone 108. For example, nose cone 108 can include internal perforations or joints that cause nose cone 108 to deform or break apart, precluding nose cone 108 from interfering with operation of fuze 104 upon impact. In some embodiments, nose cone 108 is manufactured using a material that can withstand flight dynamics and vibrations and atmospheric conditions (temperature, air pressure, precipitation, humidity, etc.) yet not impede fuze 108 from activating upon impact in the same manner as if nose cone 108 was not present. Examples described herein include plastics and metals of suitable strength, durability, and deformability, such as ABS, PEEK, aluminum, rubber, or combinations of such materials.

In some embodiments, nose cone 108 is pressure fitted to fuze 104, to slots, rings, wrench flats, annular grooves or other features 106, to warhead 102, or to any combination of these elements. Nose cone 108 can, in some embodiments, be permanently affixed to ordnance 200. In some other embodiments, nose cone 108 can be removably attached to ordnance 200 to permit disassembly of one or more parts of ordnance 200 and to permit field installation and assembly. In yet some other embodiments, nose cone 108 can be installed at the time of manufacture of ordnance 200. In yet some other embodiments, nose cone 108 can be installed in the field after the manufacture of ordnance 200. In some embodiments, nose cone 108 can be attached to or detached from ordnance 200 without tools, such as by attaching nose cone 108 by fitting, snapping, screwing, or adhering it to features 106. For example, nose cone 108 may include deformable, flexible, or movable attachment points designed to snap or lock into slots/rings/grooves 106, or screw threads designed to screw into corresponding features 106 on fuze 104 by hand.

Figure 3:
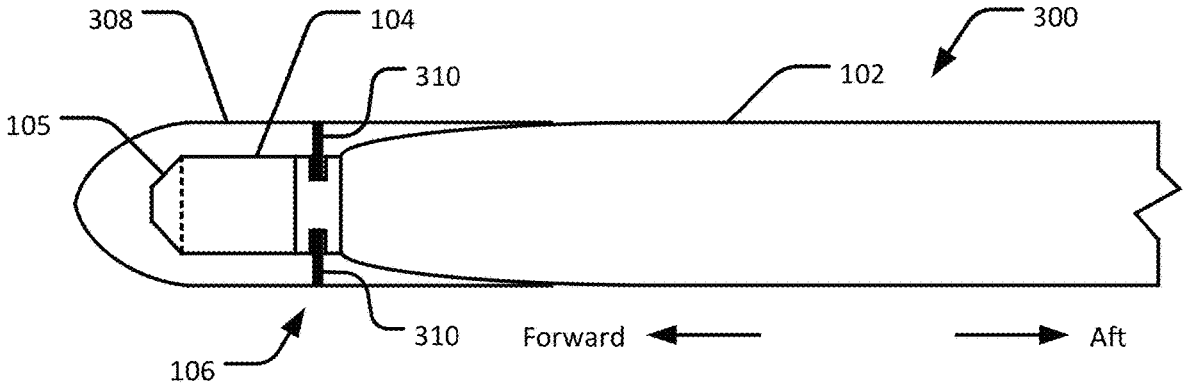
FIG. 3 is a side view of another example ordnance with a nose cone, in accordance with an embodiment of the present disclosure.

FIG. 3 shows another example ordnance 300 with a nose cone 308, in accordance with an embodiment of the present disclosure. Ordnance 300 is similar to ordnance 100 of FIG. 1 and further includes nose cone 308 mounted over fuze 104, nose cap 105, and at least a portion of warhead 102 to smooth air flow over fuze 104, nose cap 105, and the body of warhead 102. In some embodiments, nose cone 308 is a lightweight semi-rigid plastic, aluminum, or other suitable material that can be attached to the ordnance 300 without adversely affecting the function of fuze 104 upon impact. For example, nose cone 108 can be manufactured using ABS, PEEK, aluminum, or another material with similar properties. Such materials transfer a fuze activation force sufficient to activate fuze 104 (for example, 300 pounds or more). In a further embodiment, the unguided rocket can include a guidance and navigation section such as the APKWS® guidance kit that converts an unguided rocket to a guided rocket.

Nose cone 308 has a shape that improves the aerodynamic profile of ordnance 300 in comparison to ordnance 100 of FIG. 1, in which fuze 104 is exposed. For instance, when ordnance 300 includes a Hydra 70 2.75-inch fin stabilized unguided rocket, nose cone 108 can have an ogive shape that smooths air flow over the fins, which improves the range and the maneuverability of the rocket.

Nose cone 308 can have any number of different shapes that affect the aerodynamic characteristics of ordnance 300, such as shapes having a smooth external surface or an external surface that includes annular or longitudinal ridges, grooves, fins, or other surface features that reduce drag-inducing turbulence over and around ordnance 300 or aid in controlling the trajectory or other flight characteristics of ordnance 300.

In some embodiments, some or all of the external surface of nose cone 308 is coated or embedded with a paint or another material that improves airflow dynamics over nose cone 308 and reduces ice and water accumulation. In some embodiments, some or all of the external surface of nose cone 308 can be coated or embedded with a paint or other material that provides camouflage or counter-illumination. In some embodiments, some or all of the external surface of nose cone 308 can be coated or manufactured with a radiation-absorbent material or non-reflecting material designed to absorb or scatter electromagnetic radiation, light, or sound to provide, for example, radar or sonar counter-measures or to reduce the detectability of ordnance 300.

In some embodiments, nose cone 308 can include structural features designed to control deformation of nose cone 308. For example, nose cone 308 can include internal perforations or joints that cause nose cone 308 to deform or break apart, precluding nose cone 308 from interfering with operation of fuze 304 upon impact. In some embodiments, nose cone 308 is manufactured using a material that can withstand flight dynamics and vibrations and atmospheric conditions (temperature, air pressure, precipitation, humidity, etc.) yet not impede fuze 308 from activating upon impact in the same manner as if nose cone 308 was not present. Examples described herein include plastics and metals of suitable strength, durability, and deformability, such as ABS, PEEK, aluminum, rubber, or combinations of such materials.

In some embodiments, nose cone 308 is coupled or attached to fuze 104, slots, rings, or annular grooves 106, warhead 102, or any combination of these elements via a fastener 310, tab, or member that engages with slots, rings, wrench flats, annular grooves, or other annular features 106 of ordnance 300. In some such embodiments, fastener 310 includes a flexible member that deflects when pressed against ordnance 300 and then snaps into slots, rings, wrench flats, or annular grooves 106 when aligned as shown in FIG. 3. Examples of a flexible member include deformable features molded or attached to nose cone 310. Such a flexible member can be configured to have an interference fit with the slots, rings, wrench flats, or annular grooves 106. Such an interference fit causes the rigid member to rest tightly and securely against the features 106. The deformable nature of the flexible member permits the member to adapt to the shape of the features 106 for a secure fit and absorb vibrations without loosening.

In other such embodiments, fastener 310 includes a rigid member that engages slots, rings, wrench flats, or annular grooves 106. Examples of a rigid member include a lock wire or plastic molding. The rigid member can, for example, be configured to snap into the slots, rings, wrench flats, or annular grooves 106. In another example, the rigid member can be configured to have an interference fit with the slots, rings, wrench flats, or annular grooves 106. Such an interference fit causes the rigid member to rest tightly and securely against the features 106. Nose cone 308 can, in some embodiments, be permanently affixed to ordnance 300. In some other embodiments, nose cone 308 can be removably attached to ordnance 300 to permit disassembly of one or more parts of ordnance 300. In yet some other embodiments, nose cone 308 can be installed at the time of manufacture of ordnance 300. In yet some other embodiments, nose cone 308 can be installed in the field after the manufacture of ordnance 300. In some embodiments, nose cone 308 can be attached to or detached from ordnance 300 without tools, such as by attaching nose cone 308 by fitting, snapping, screwing, or adhering it to features 106. For example, nose cone 308 may include deformable, flexible, or movable attachment points designed to snap or lock into slots/rings/grooves 106, or screw threads designed to screw into corresponding features 106 on fuze 104 by hand or using a tool.

Figure 5:
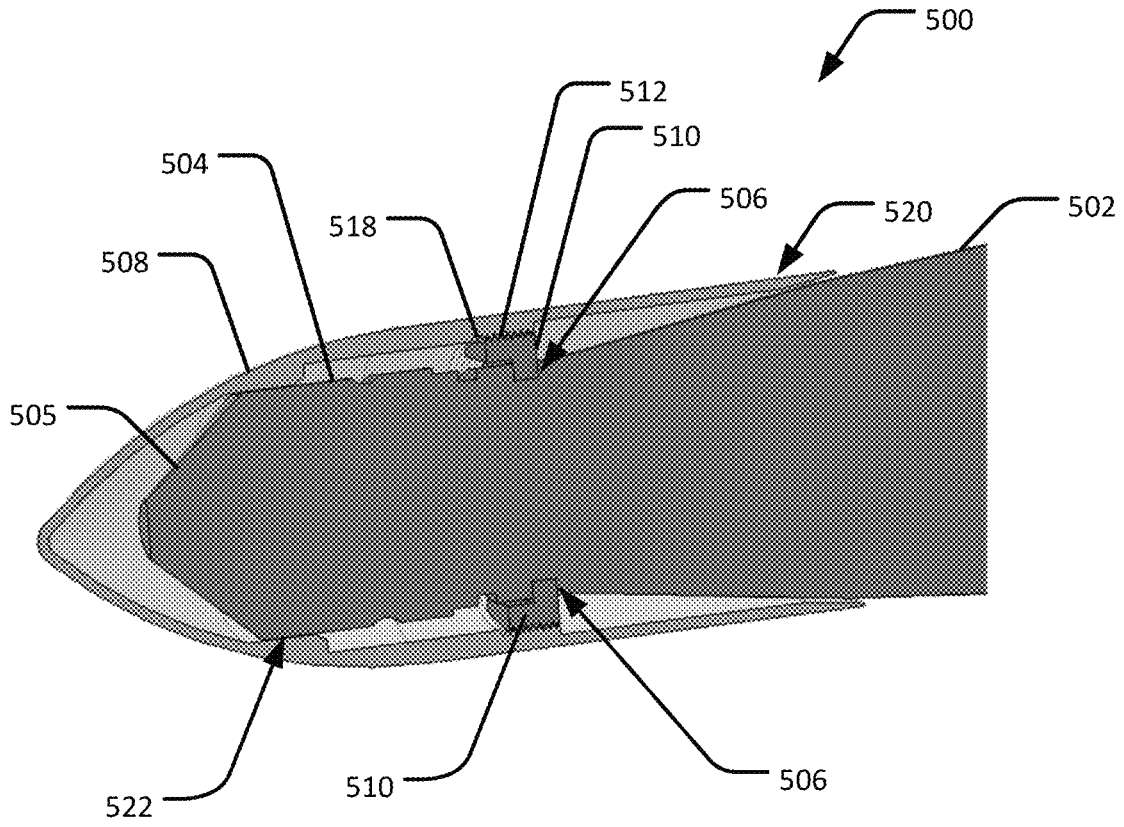
FIG. 5 is a perspective view of yet another example ordnance with a nose cone, in accordance with an embodiment of the present disclosure.

FIG. 5 shows another example ordnance 500 with a nose cone 508, in accordance with an embodiment of the present disclosure. Ordnance 500 is similar to ordnance 100 of FIG. 1 and further includes nose cone 508 mounted over a fuze 504, a nose cap 505, and at least a portion of a warhead 502 to smooth air flow over fuze 504, nose cap 505, and the body of warhead 502. Nose cap 505 is attached to the forward-most portion of fuze 504. In some embodiments, nose cone 508 is a lightweight semi-rigid plastic, aluminum, or other suitable material that can be attached to the ordnance 500 without adversely affecting the function of fuze 504 upon impact. For example, nose cone 508 can be manufactured using ABS, PEEK, aluminum, or another material with similar properties. Such materials transfer a fuze activation force sufficient to activate fuze 504 (for example, 300 pounds or more). In a further embodiment, the unguided rocket can include a guidance and navigation section such as the APKWS® guidance kit that converts an unguided rocket to a guided rocket.

Nose cone 508 can have any number of different shapes that affect the aerodynamic characteristics of ordnance 500, such as shapes having a smooth external surface or an external surface that includes annular or longitudinal ridges, grooves, fins, or other surface features that reduce drag-inducing turbulence over and around ordnance 500 or aid in controlling the trajectory or other flight characteristics of ordnance 500.

In some embodiments, some or all of the external surface of nose cone 508 is coated or embedded with a paint or another material that improves airflow dynamics over nose cone 508 and reduces ice and water accumulation. In some embodiments, some or all of the external surface of nose cone 508 can be coated or embedded with a paint or other material that provides camouflage or counter-illumination. In some embodiments, some or all of the external surface of nose cone 508 can be coated or manufactured with a radiation-absorbent material or non-reflecting material designed to absorb or scatter electromagnetic radiation, light, or sound to provide, for example, radar or sonar counter-measures or to reduce the detectability of ordnance 500.

In some embodiments, nose cone 508 can include structural features designed to control deformation of nose cone 508. For example, nose cone 508 can include internal perforations or joints that cause nose cone 508 to deform or break apart, precluding nose cone 508 from interfering with operation of fuze 504 upon impact. In some embodiments, nose cone 508 is manufactured using a material that can withstand flight dynamics and vibrations and atmospheric conditions (temperature, air pressure, precipitation, humidity, etc.) yet not impede fuze 508 from activating upon impact in the same manner as if nose cone 508 was not present. Examples described herein include plastics and metals of suitable strength, durability, and deformability, such as ABS, PEEK, aluminum, rubber, or combinations of such materials.

Nose cone 508 is attached to warhead 502 via a threaded "C" ring 510, which slips over wrench flats 506 on fuze 504. In certain embodiments, ring 510 is "C" shaped with an open jaw design to fit around a surface of fuze 504. Wrench flats 506 include one or more flat surfaces for attaching a wrench or other suitable tool and can be used for securing fuze 504 onto warhead 702 as well as for attaching ring 510 to fuze 504 using a wrench or other suitable tool. In certain embodiments, ring 510 includes deformable features to provide an interference fit between ring 510 and wrench flats 506, which reduce play between the flat surfaces of ring 510 and fuze 504. In certain embodiments, ring 510 is made of aluminum, high strength plastic, or another suitable material.

In use, nose cone 508 slides or rotates over fuze 504 and warhead 502. Nose cone 508 includes threads 518 that engage threads 512 on ring 510. Nose cone 508 is tightened against warhead 502, as indicated at 520, by rotating threads 518 of nose cone 508 over threads 512 on ring 510. A thread-locking compound (for example, Loctite® thread locker) or a thread-locking device can be applied to the threads 512 of ring 510 prior to installing nose cone 508 to prevent loosening of the assembly during vibration. Warhead 502 and fuze 504 center nose cone 508 with respect to ordnance 500. Ordnance 500 is easy to assemble and has no blind alignments of features. For example, the external shape of fuze 504 and the internal shape of nose cone 508 fit together, such as indicated at 522, to align threads 518 of nose cone 508 to threads 512 of ring 510. The attachment design of nose cone 508 allows for aerodynamic shape optimization of leading surfaces of nose cone 508.

Figure 6:
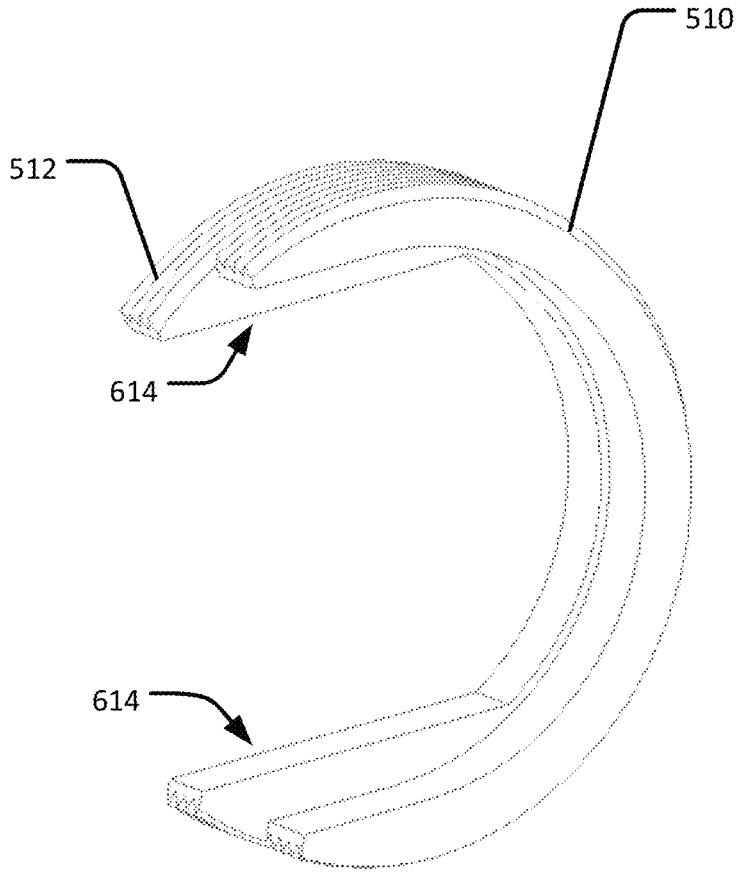
FIG. 6 is a perspective view of a threaded "C" ring for use in conjunction with an example ordnance, in accordance with certain embodiments of the present disclosure.

FIG. 6 shows threaded "C" ring 510 of FIG. 5 in further detail, in accordance with certain embodiments of the present disclosure. Ring 510 includes threads 512 and flat surfaces 614 configured to engage with wrench flats 506 on fuze 504. In certain embodiments, flat surfaces 614 of ring 510 are deformable to provide an interference fit between ring 510 and wrench flats 506 on fuze 504. In certain other embodiments, flat surfaces 614 are rigid.

Figure 7A:
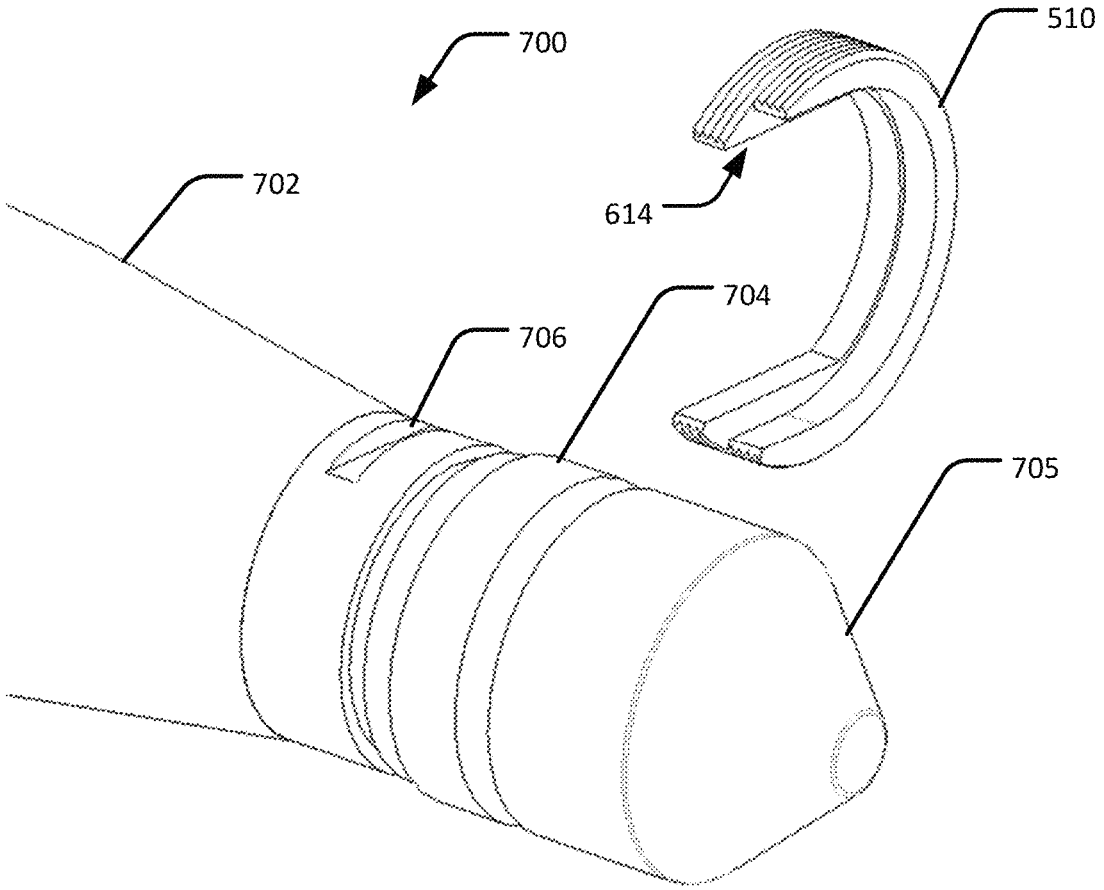
FIGS. 7A, 7B, 8A and 8B are perspective views of an example ordnance assembly, in accordance with an embodiment of the present disclosure.
Figure 7B:
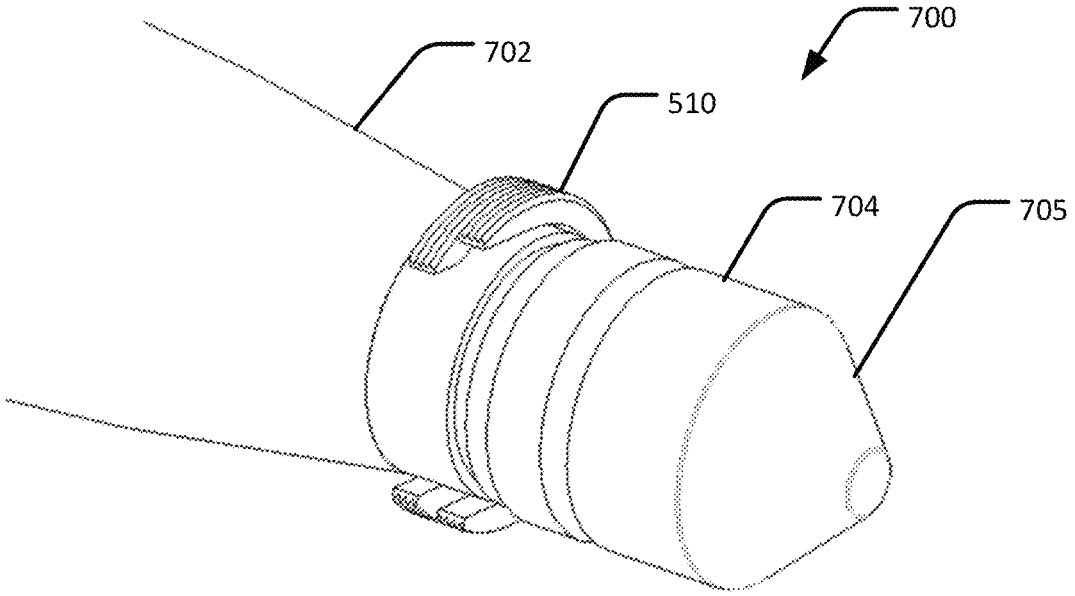

FIGS. 7A and 7B are perspective views of an example ordnance assembly 700, in accordance with an embodiment of the present disclosure. Ordnance assembly 700 includes a warhead 702, a fuze 704, and a nose cap 705. Nose cap 705 is attached to the forwardmost portion of fuze 704. FIG. 7A is a partially exploded perspective view of ordnance assembly 700 where ring 510 is separated from fuze 704. Fuze 704 includes one or more wrench flats 706 configured to engage with flat surfaces 614 of ring 510. Wrench flats 706 can be used to secure fuze 704 to warhead 702 prior to fitting ring 510 to fuze 704. FIG. 7B is a perspective view of ordnance assembly 700 where ring 510 is coupled to or engaged with fuze 704 over and on wrench flats 706.

Figure 8A:
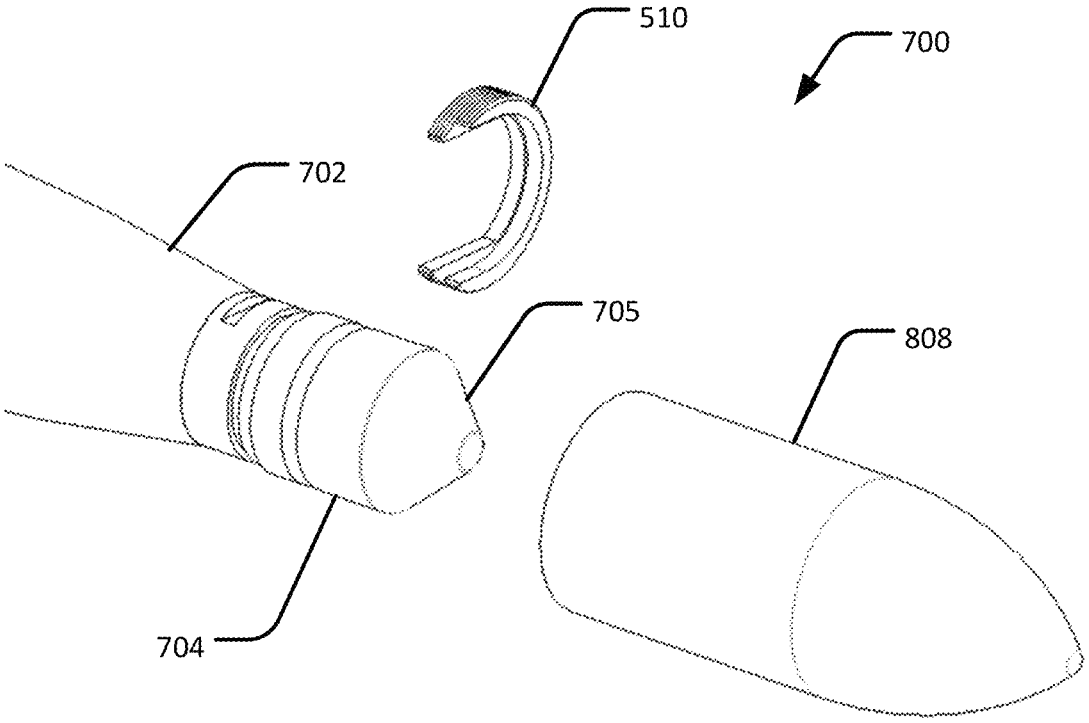
Figure 8B:
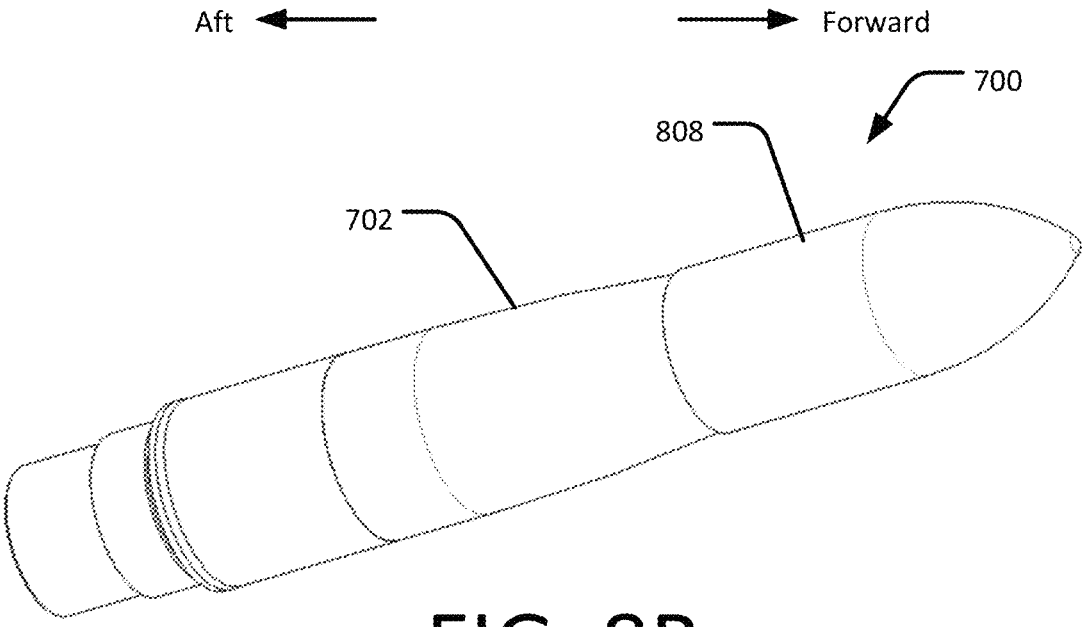

FIGS. 8A and 8B are further perspective views of ordnance assembly 700 of FIGS. 7A and 7B, in accordance with certain embodiments of the present disclosure. Ordnance assembly 700 includes warhead 702, fuze 704, and nose cone 808. FIG. 8A is a partially exploded perspective view of ordnance assembly 700 where ring 510 and nose cone 808 are separated from fuze 704. FIG. 8B is a perspective view of ordnance assembly 700 in flight configuration where nose cone 808 is attached to fuze 704 via ring 510, for example, by attaching ring 510 to fuze 704 and then screwing nose cone 808 onto ring 510. In FIG. 8B, nose cone 808 is mounted over and covers fuze 704, nose cap 705, and at least a portion of warhead 702 to smooth air flor over fuze 704, nose cap 705, and the body of warhead 702. In a further embodiment, the unguided rocket can include a guidance and navigation section such as the APKWS® guidance kit that converts an unguided rocket to a guided rocket.

Figure 9:
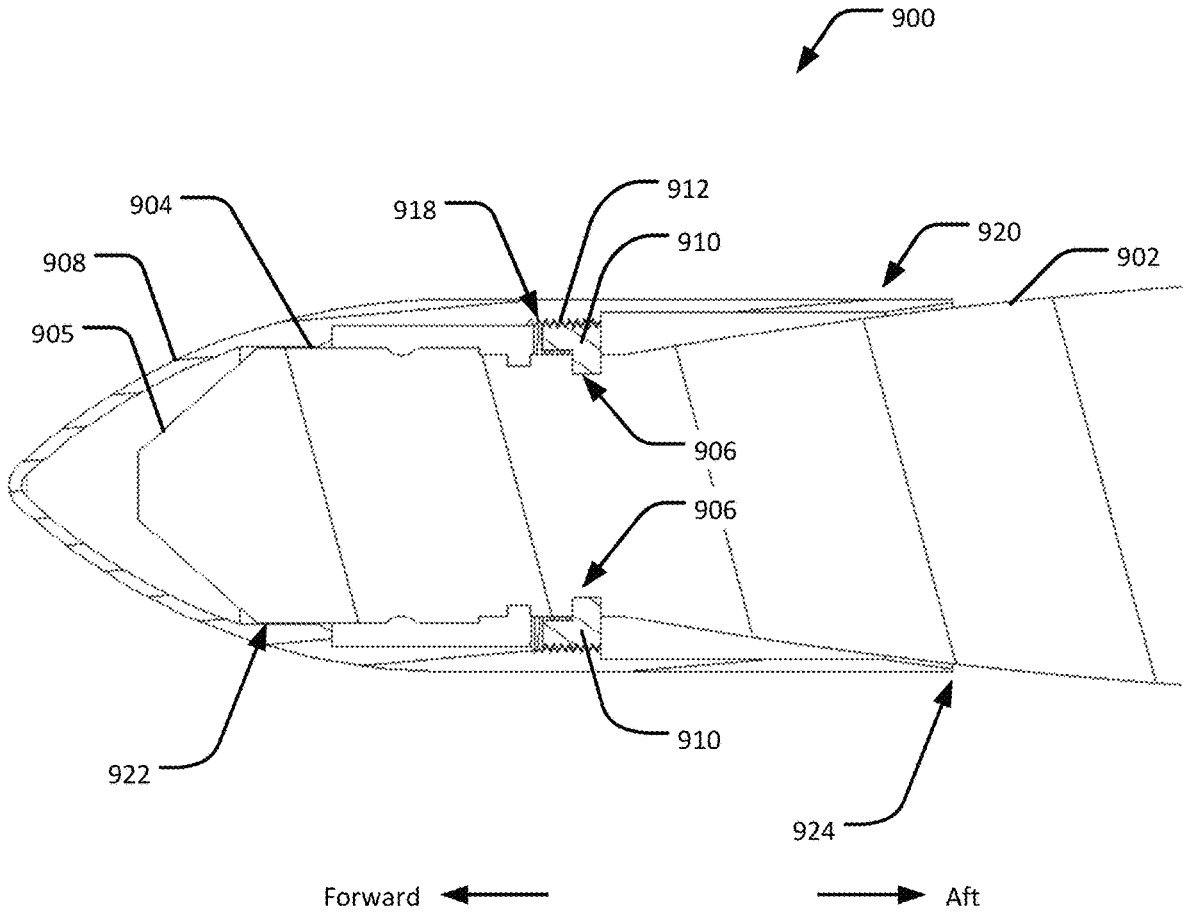
FIG. 9 is a perspective view of another example ordnance with a nose cone, in accordance with an embodiment of the present disclosure.

FIG. 9 shows another example ordnance 900 with a nose cone 908, in accordance with an embodiment of the present disclosure. Ordnance 900 includes nose cone 908 mounted over a fuze 904, a nose cap 905, and at least a portion of a warhead 902 to smooth air flow over fuze 904, nose cap 905, and the body of warhead 902. Nose cap 905 is attached to the forwardmost portion of fuze 504. In some embodiments, fuze 904 and warhead 902 are inert components (a slug) and can be a single component or multiple components. In some embodiments, nose cone 908 is a lightweight semi-rigid plastic, aluminum, or other suitable material that can be attached to the ordnance 900 without adversely affecting the function of fuze 904 upon impact. For example, nose cone 908 can be manufactured using ABS, PEEK, aluminum, or another material with similar properties. Upon impact, such materials transfer a fuze activation force sufficient to activate fuze 904 (for example, 300 pounds or more). In a further embodiment, the unguided rocket can include a guidance and navigation section such as the APKWS® guidance kit that converts an unguided rocket to a guided rocket.

Nose cone 908 can have any number of different shapes that affect the aerodynamic characteristics of ordnance 900, such as shapes having a smooth external surface or an external surface that includes annular or longitudinal ridges, grooves, fins, or other surface features that reduce drag-inducing turbulence over and around ordnance 900 or aid in controlling the trajectory or other flight characteristics of ordnance 900.

In some embodiments, some or all of the external surface of nose cone 908 is coated or embedded with a paint or another material that improves airflow dynamics over nose cone 908 and reduces ice and water accumulation. In some embodiments, some or all of the external surface of nose cone 908 can be coated or embedded with a paint or other material that provides camouflage or counter-illumination. In some embodiments, some or all of the external surface of nose cone 908 can be coated or manufactured with a radiation-absorbent material or non-reflecting material designed to absorb or scatter electromagnetic radiation, light, or sound to provide, for example, radar or sonar counter-measures or to reduce the detectability of ordnance 900.

In some embodiments, nose cone 908 can include structural features designed to control deformation of nose cone 908. For example, nose cone 908 can include internal perforations or joints that cause nose cone 908 to deform or break apart, precluding nose cone 908 from interfering with operation of fuze 904 upon impact. In some embodiments, nose cone 908 is manufactured using a material that can withstand flight dynamics and vibrations and atmospheric conditions (temperature, air pressure, precipitation, humidity, etc.) yet not impede fuze 908 from activating upon impact in the same manner as if nose cone 908 was not present. Examples described herein include plastics and metals of suitable strength, durability, and deformability, such as ABS, PEEK, aluminum, rubber, or combinations of such materials.

Nose cone 908 is attached to warhead 902 via a threaded "C" ring 910, which slips over slots, rings, wrench flats, annular grooves, or other features 906 on fuze 904, on warhead 902, or on a combination of fuze 902 and warhead 902. In certain embodiments, ring 910 is "C" shaped with an open jaw design to fit around an outer surface of fuze 904 or warhead 902. Wrench flats 906 can be used for attaching fuze 904 to warhead 902 as well as for attaching ring 910 to fuze 904 or warhead 902. In certain embodiments, ring 910 includes deformable features to provide an interference fit between ring 910 and wrench flats 906, which reduce play between the flat surfaces of ring 910 and fuze 904 or warhead 902. In certain embodiments, ring 910 is made of aluminum, high strength plastic, or another suitable material.

In use, nose cone 908 slides and rotates over fuze 904 and warhead 902. Nose cone 908 engages threads 912 on ring 910. Nose cone 908 is tightened against warhead 902, as indicated at 920, by rotating nose cone 908 over threads 912 on ring 910. A thread-locking compound (for example, Loctite® thread locker) or a thread-locking device can be applied to the threads of ring 910 prior to installing nose cone 908 to prevent loosening of the assembly during vibration. Warhead 902 and fuze 904 center nose cone 908 with respect to ordnance 900. The ordnance 900 is easy to assemble and there are no blind alignments of features. For example, the external shape of fuze 904 and the internal shape of nose cone 908 fit together, such as indicated at 922, to align threads 918 of nose cone 908 to threads 912 of ring 910. The attachment design of nose cone 908 allows for aerodynamic shape optimization of leading surfaces of nose cone 908. When attached, nose cone 908 is flush or nearly flush with the outer surface of warhead 902, such as indicated at 924.

Numerous embodiments will be apparent in light of the present disclosure, and features described herein can be combined in any number of configurations. One example embodiment provides an ordnance including a threaded "C" ring configured to be coupled to at least one of a fuze and a warhead; and a nose cone configured to be coupled to the ring and to cover the fuze, a nose cap attached to a forwardmost portion of the fuze, and at least a portion of the warhead to smooth air flow over the fuze, the nose cap, and the warhead. In some cases, the nose cone includes threads configured to engage with the ring. In some cases, a surface of the fuze includes one or more wrench flats configured to engage with one or more flat surfaces of the ring. In some such cases, the one or more flat surfaces of the ring include deformable features. In some cases, the nose cone has an ogive shape. In some cases, the nose cone includes at least one of a plastic material and a metal material. In some such cases, the plastic material includes at least one of Acrylonitrile Butadiene Styrene (ABS) and polyetheretherketone (PEEK), and wherein the metal material includes aluminum.

Another example embodiment provides an ordnance including a fastener configured to be coupled to at least one slot, ring, wrench flat, or annular groove disposed on at least one of a fuze and a warhead; and a nose cone configured to be coupled to the at least one slot, ring, wrench flat, or annular groove via the fastener and to cover the fuze, a nose cap attached to a forwardmost portion of the fuze, and at least a portion of the warhead to smooth air flow over the fuze, the nose cap, and the warhead. In some cases, the fastener includes a threaded "C" ring. In some such cases, the nose cone includes threads configured to engage with the ring. In some cases, the fastener includes a flexible member that deflects when pressed against ordnance and is configured to snap into the at least one slot, ring, wrench flat, or annular groove. In some cases, the fastener includes a rigid member configured to engage with the at least one slot, ring, wrench flat, or annular groove.

Yet another example embodiment provides a kit including a fuze and/or a warhead, the fuze configured to be coupled to a forward portion of the warhead; a fastener configured to be coupled to at least one slot, ring, wrench flat, or annular groove disposed on at least one of the fuze and the warhead; and a nose cone configured to be coupled to the fastener and to cover the fuze, a nose cap attached to a forwardmost portion of the fuze, and at least a portion of the warhead to smooth air flow over the fuze, the nose cap, and the warhead. In some cases, the fastener includes a threaded "C" ring, and wherein the nose cone is configured to be coupled to the fuze via the ring. In some such cases, the nose cone includes threads configured to engage with the ring. In some other such cases, a surface of the fuze includes one or more wrench flats configured to engage with one or more flat surfaces of the ring. In some cases, the fastener includes a flexible member that deflects when pressed against ordnance and is configured to snap into the at least one slot, ring, wrench flat, or annular groove. In some cases, the fastener includes a rigid member configured to engage with the at least one slot, ring, wrench flat, or annular groove. In some cases, the nose cone includes at least one of a plastic material and a metal material, wherein the plastic material includes at least one of Acrylonitrile Butadiene Styrene (ABS) and polyetheretherketone (PEEK), and wherein the metal material includes aluminum. In some cases the nose cone has an ogive shape.

The foregoing description and drawings of various embodiments are presented by way of example only. These examples are not intended to be exhaustive or to limit the disclosed subject matter to the precise forms disclosed. Alterations, modifications, and variations will be apparent in light of this disclosure and are intended to be within the scope of the disclosed subject matter as set forth in the claims.

What is claimed is:

1. An ordnance comprising:

a threaded "C" ring configured to be coupled to an outer surface of the ordnance; and a nose cone configured to be coupled to the threaded "C" ring wherein the nose cone covers a forward portion of the ordnance to smooth air flow.

2. The ordnance of claim 1, wherein the nose cone includes threads configured to engage with the threaded "C" ring.

3. The ordnance of claim 1, wherein the outer surface of the ordnance includes one or more wrench flats configured to engage with one or more flat surfaces of the threaded "C" ring.

4. The ordnance of claim 3, wherein the one or more flat surfaces of the threaded "C" ring include deformable features.

5. The ordnance of claim 1, wherein the nose cone has an ogive shape.

6. The ordnance of claim 1, wherein the nose cone includes at least one of a plastic material and a metal material.

7. The ordnance of claim 6, wherein the plastic material includes at least one of Acrylonitrile Butadiene Styrene (ABS) and polyetheretherketone (PEEK), and wherein the metal material includes aluminum.

8. The ordnance of claim 1, wherein the nose cone comprises a radiation-absorbent material or a non-reflecting material to absorb or scatter electromagnetic radiation, light, or sound.

9. The ordnance of claim 1, wherein an external surface of the nose cone comprises annular ridges, longitudinal ridges, grooves, or fins to reduce drag-inducing turbulence about the ordnance.

10. An ordnance comprising:

a nose cap on a forward portion of the ordnance and coupled to the ordnance;

one or more features on an outer surface of the ordnance, the features comprising at least one slot, ring, wrench flat, or annular groove;

a fastener configured to be coupled to the at least one slot, ring, wrench flat, or annular groove;

a nose cone configured to be coupled to the at least one slot, ring, wrench flat, or annular groove via the fastener and to smooth air flow, wherein the nose cone covers the nose cap.

11. The ordnance of claim 10, wherein the fastener includes is a threaded "C" ring.

12. The ordnance of claim 11, wherein the nose cone includes threads configured to engage with the threaded "C" ring.

13. The ordnance of claim 10, wherein the fastener includes a flexible member that deflects when pressed against the ordnance and is configured to snap into the at least one slot, ring, wrench flat, or annular groove.

14. The ordnance of claim 10, wherein the fastener includes a rigid member configured to engage with the at least one slot, ring, wrench flat, or annular groove.

15. An ordnance kit comprising:

a fastener configured to be coupled to at least one slot, ring, wrench flat, or annular groove disposed on an outer surface of an ordnance;

a nose cone configured to be coupled to the fastener and to cover a forward portion of the ordnance to smooth air flow; and wherein the nose cone comprises a radiation-absorbent material or a non-reflecting material to absorb or scatter electromagnetic radiation, light, or sound.

16. The kit of claim 15, wherein the fastener is a threaded "C" ring, and wherein the nose cone is configured to be coupled via the ring.

17. The kit of claim 15, wherein the fastener includes a flexible member that deflects when pressed against ordnance and is configured to snap into the at least one slot, ring, wrench flat, or annular groove.

18. The kit of claim 15, wherein the fastener includes a rigid member configured to engage with the at least one slot, ring, wrench flat, or annular groove.

19. The kit of claim 15, wherein the nose cone includes at least one of a plastic material and a metal material, wherein the plastic material includes at least one of Acrylonitrile Butadiene Styrene (ABS) and polyetheretherketone (PEEK), and wherein the metal material includes aluminum.

20. The kit of claim 15, wherein the nose cone has an ogive shape.

* * * * *